US009064645B2

(12) United States Patent
Nereau et al.

(10) Patent No.: US 9,064,645 B2
(45) Date of Patent: Jun. 23, 2015

(54) ASSEMBLY OF A MULTIPOLE SWITCHGEAR DEVICE WITH DOUBLE ENCLOSURE AND CIRCUIT BREAKER COMPRISING THE SAME

(75) Inventors: Jean-Pierre Nereau, Seyssinet (FR); Christophe Grumel, Lans en Vercors (FR); Marc Rival, Saint Ismier (FR); Hervé Anglade, Saint Ismier (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 305 days.

(21) Appl. No.: 13/393,775

(22) PCT Filed: Aug. 30, 2010

(86) PCT No.: PCT/FR2010/000593

§ 371 (c)(1),
(2), (4) Date: Mar. 1, 2012

(87) PCT Pub. No.: WO2011/033183

PCT Pub. Date: Mar. 24, 2011

(65) Prior Publication Data

US 2012/0160654 A1 Jun. 28, 2012

(30) Foreign Application Priority Data

Sep. 18, 2009 (FR) ..... 09 04459

(51) Int. Cl.

| | |
|---|---|
| ***H01H 13/70*** | (2006.01) |
| ***H01H 25/00*** | (2006.01) |
| ***H01H 25/04*** | (2006.01) |
| ***H01H 1/20*** | (2006.01) |
| *H01H 71/02* | (2006.01) |

(52) U.S. Cl.

CPC ..... *H01H 1/2058* (2013.01); *H01H 13/70* (2013.01); *H01H 71/0235* (2013.01); *H01H 2071/0285* (2013.01)

(58) Field of Classification Search

CPC ..... H01H 9/0044; H01H 73/00; H01H 77/00; H01H 79/00; H01H 81/00; H01H 2077/00; H01H 9/00; H01H 71/00; H01H 71/10; H01H 75/00; H01H 2003/00; H01H 5/00; H01H 13/70; H01H 25/00; H01H 25/04; H01H 71/02; H01H 71/025; H01H 73/06; H01H 2009/02; H01H 2009/0285; H01H 2009/04; H01H 2211/006; H01H 2211/026; H01H 2223/00; H01H 2227/024

USPC ..... 200/401, 400, 288, 50.19, 50.02, 410, 200/411, 430, 431, 428, 440–442, 318, 321, 200/324, 325, 327, 335, 6 R

See application file for complete search history.

(56) References Cited

U.S. PATENT DOCUMENTS

| | | | | |
|---|---|---|---|---|
| 4,563,557 | A * | 1/1986 | Leone | 200/288 |
| 4,951,019 | A * | 8/1990 | Gula | 335/166 |
| 5,281,776 | A | 1/1994 | Morel et al. | |
| 5,298,874 | A * | 3/1994 | Morel et al. | 335/8 |
| 7,750,259 | B2 * | 7/2010 | Besana et al. | 200/244 |
| 2007/0075808 | A1 * | 4/2007 | Ahn | 335/6 |
| 2008/0185275 | A1 * | 8/2008 | Curnis et al. | 200/335 |

FOREIGN PATENT DOCUMENTS

| | | | |
|---|---|---|---|
| DE | 70 44 973 | U | 4/1971 |
| EP | 0 542 636 | A1 | 5/1993 |
| EP | 0 694 946 | A1 | 1/1996 |
| EP | 1 126 487 | A2 | 8/2001 |
| EP | 1 187 158 | A1 | 3/2002 |
| FR | 2 682 530 | | 4/1993 |
| WO | WO 01/39231 | A1 | 5/2001 |
| WO | WO 03/050835 | A1 | 6/2003 |

* cited by examiner

*Primary Examiner* — Edwin A. Leon
*Assistant Examiner* — Anthony R. Jimenez
(74) *Attorney, Agent, or Firm* — Steptoe & Johnson LLP

(57) ABSTRACT

In order to take maximum advantage of the modularity provided by a multipole circuit breaker with double enclosure (100), a new architecture is proposed. The outer case (48) of the switchgear apparatus (100) is formed directly when assembly of the breaking device (600) is performed by juxtaposition and securing between single-pole breaking units (10), spacers (46) and side walls (50), trip device (7) and cover (64). The spacers (46) can thus be used for various functionalities, and in particular to modify the external aspect of the switchgear apparatus (100) or the nature of the trip device (7) in delayed manner.

13 Claims, 5 Drawing Sheets

ASSEMBLY OF A MULTIPOLE SWITCHGEAR DEVICE WITH DOUBLE ENCLOSURE AND CIRCUIT BREAKER COMPRISING THE SAME

This application is a national stage entry of International Application No. PCT/FR2010/000593, filed Aug. 30, 2010 designating the U.S., which claims the benefit of French Application No. 09/04459, filed Sep. 18, 2009.

TECHNICAL FIELD

The invention relates to a modular low-voltage multipole circuit breaker wherein a trip device is common to all the poles which each comprise an independent breaking cartridge. The invention relates to a new architecture for this type of circuit breakers in which the conventional double enclosure is modified to optimize the modularity for different functions and/or sizes to be parameterized in the circuit breaker.

STATE OF THE ART

A conventional low-voltage multipole switchgear apparatus 1, generally a circuit breaker, as described in EP 0 542 636 and illustrated in FIG. 1, comprises a double enclosure: an outer case 2 of the circuit breaker 1 houses a plurality of single-pole current breaking units 3 between a line-side terminal strip 4 connected to the line to be protected and a load-side terminal strip 5. The set of units 3 in the case 2 forms the breaking device 6 which is connected to a single trip device 7 at the level of the load-side terminal strips 5. Each unit 3, also called cartridge, comprises a case in which there is housed a breaking mechanism, in particular at least one pair of contacts able to take an open disengaged position and a closed current flow position, associated with an arc extinguishing chamber. One of the units 3 is associated with an actuating mechanism 8. This type of architecture has the notable advantage of reducing manufacturing and storage costs due to the modularity of the breaking units 3. Assembly of the circuit breaker 1 is moreover quite simple.

Different technological choices have been developed, in particular as far as the nature of the breaking mechanism is concerned, with however limits for each of them. For example, to simplify connections, some circuit breakers use direct rear plug-in between the trip device 7 and single-breaking device 6 (EP 1 126 487). However, single breaking reaches its limits for certain electric performances. To overcome this limitation, some circuit breakers 1 use double breaking in parallel (WO 01/39231) which imposes a notable volume of the cartridges 3 and therefore a large width of the circuit breakers 1 with a longer pitch between poles. Other circuit breakers 1 (EP 0 542 636) limit the size as far as the width is concerned by using rotary double breaking which does however lead to a vertical offset of the location of the nose 9 of the apparatus 1, the part of the cover from which the tripping handle of the actuating mechanism 8 emerges, imposing the use of asymmetric front plates in the cabinets. Furthermore, the exhaust outlet of the gases is very close to the circuit breaker 7 and to the terminals which it is therefore important to protect by any means, safety perimeter and/or accessories to prevent nuisance arc flashovers. Furthermore, existing rotary double breaking devices are based on insertion via the front of the trip device 7, i.e. via the face comprising the nose 9 and the handle of the circuit breaker 1, which gives rise to difficulties of connection and complex assembly.

SUMMARY OF THE INVENTION

Among other advantages, the object of the invention is to palliate the shortcomings of existing multipole switchgear apparatuses with double enclosure. In particular, the object of the invention is to take maximum advantage of the modularity provided by the use of single-pole breaking cartridges and standardization of the trip devices.

One of the objects of the invention therefore aims to obtain a switchgear device achieved by a succession of steps for which selection from a limited number of elements enables different criteria of use to be satisfied, in particular the type of assembly in the panels (fitting on rail or not), and the pitch (metric or imperial) between the poles. Likewise, one of the objects of the invention is to facilitate interchangeability of the trip devices for apparatuses comprising said switchgear device.

Another object of the invention is the ruggedness of the switchgear device over a low-voltage range up to 630 A, or even 800 A, while at the same time keeping the height dimension of the device within the available values to avoid problems of fitting in panels. For example, for a 160 A circuit breaker, the "overall" height of the switchgear device, i.e. without accessories, is about 130 mm.

To optimize fitting in the panel, another object of the invention is to centre the nose of the cover of the switchgear device with respect to its total height. For example, for the same 160 A circuit breaker, the 45 mm nose is located 42.5 mm from the top of the unit.

The solutions provided by the invention are defined in the claims which follow.

According to one feature, the invention thus relates to a method for assembly of a multipole switchgear device comprising juxtaposition of single-pole breaking units, along their large panel, between which spacers, which are advantageously identical to one another, are inserted to secure the units and which, in conjunction with side walls which are parallel thereto, form the double enclosure. A double enclosure is thus composed of two substantially solid lateral surfaces, orthogonal to a bottom surface and to a top surface, the two latter surfaces being adjacent and orthogonal to one another.

In particular, each single-pole breaking unit comprises a case housing a breaking mechanism, preferably with a rotary bar, or bridge, enabling double breaking, the connection terminals of which each open out from the case on two opposite small panels. According to a preferred embodiment, the direction of rotation of the bar is reversed, i.e. the connection terminal strip to the trip device, or load-side terminal strip, is located to the rear of the unit, i.e. closer to the bottom surface than to the surface opposite the bottom surface, and a gas exhaust channel is provided in the case of the single-pole unit. Advantageously, two lateral outlet openings for the quenching gases are also provided, with formation of a passage guiding said gases from one opening to the other along the case outside the cartridge.

A number of single-pole units corresponding to the number of poles of the circuit breaker is associated with a number, smaller by one, of spacers separating the latter. Each spacer comprises a central partition separating the units along their large panel. The central partition is provided with arrangements enabling operation of the switchgear device, in particular means for passage of the simultaneous drive rod of the single-pole breaking units and means for securing between units. Advantageously, the central partition comprises additional functional means, for example a lateral guiding channel of the gases operating in conjunction with a lateral passage of the breaking units, guiding means to secure the latter, protuberances for securing the cartridges and/or power connections, operating assistance means acting on the drive rod, for example springs accelerating movement of the rod on opening and/or closing, sensors etc.

The spacers and cartridges, once they have been secured and clamped by the suitable means, form a tightly sealed compact breaking assembly, i.e. the gases only flow in the passages provided for this purpose, without flowing between the cartridges. The spacers are thus provided with means for fitting and securing a switchgear device to a wall or a mounting plate, in particular guides for fixing rivets. The guides are preferably formed by holes passing through the central partitions so that it is the spacers that support the mechanical suspension force.

One side of each spacer is designed to form the bottom wall of the double enclosure of the switchgear device. Perpendicular to the central partition, a bottom edge is such that juxtaposition of two spacers results in side-by-side placing of two edges to form a solid part of said bottom wall when securing of the assembly is performed. The edge can be provided with latching means, for example a cut-out for a DIN rail, provided with a latching nose or not. The edge can run along the length of the central partition to only let the load-side connection terminal strip pass.

Another side of each spacer is designed to form the top wall of the breaking device. The spacer can thus comprise a top edge, perpendicular to the central partition and to the bottom edge, so that juxtaposition of two spacers results in side-by-side placing of two top edges to form a part of said top wall, with an opening for passage to the connection terminal strips of the single-pole breaking units and any other indicated arrangement, in particular a pass-through hole facing the gas outlet channel of the single-pole units. The top edge can be limited to the cross-section on their thickness of functional protuberances, for example protuberances perpendicular to the central partition and parallel to the bottom edge designed to secure connection terminal tunnels, or of a support parallel to the bottom wall and designed to secure a cover of the switchgear device. Whatever the embodiment, the top edge or the central partition are provided with an orthogonal element acting as creepage distance. In particular, the partition is hollowed out in its thickness in the centre of its top edge to form a slot.

The spacers are preferably symmetrical with respect to the central partition so that each cavity formed by two spacers and intended for a single-pole unit is delineated by small sides formed by the two spacers. The distance between two cavities, determined by the thickness of the central partition and the width of the edges, can be adjusted to the usual pitch of the device.

The spacers and single-pole units, one of which is coupled with an actuating mechanism, are secured to one another. Advantageously, the breaking units are guided in sliding on the spacers so as to facilitate fitting and to take the stresses up directly. The unit formed by the single-pole units and spacers is associated with simultaneous drive means, in particular a pass-through rod, and suitable connection terminals may be associated with the line-side connection terminal strips. The whole assembly is closed by side walls at each end, each wall preferably comprising two similar edges to those of the spacers and the corresponding arrangements on one of its faces, so as to form a multipole switchgear device which can be associated with a trip device and/or a closing cover to form a switchgear apparatus of circuit breaker type with double enclosure. Advantageously, the trip device is guided in sliding on the cartridges or on the spacers of the switchgear device so as to facilitate fitting and securing. The securing means of the trip device on the multipole switchgear device are preferably guided in suitable means, of guide hole type, of the spacers to increase the mechanical strength.

The invention also relates to a switchgear device and to a circuit breaker achieved by means of the above-mentioned method.

BRIEF DESCRIPTION OF THE DRAWINGS

Other advantages and features will become more clearly apparent from the following description of particular embodiments of the invention, given for illustrative and in no way restrictive example purposes only, represented in the appended figures.

DETAILED DESCRIPTION OF A PREFERRED EMBODIMENT

Figure 1:
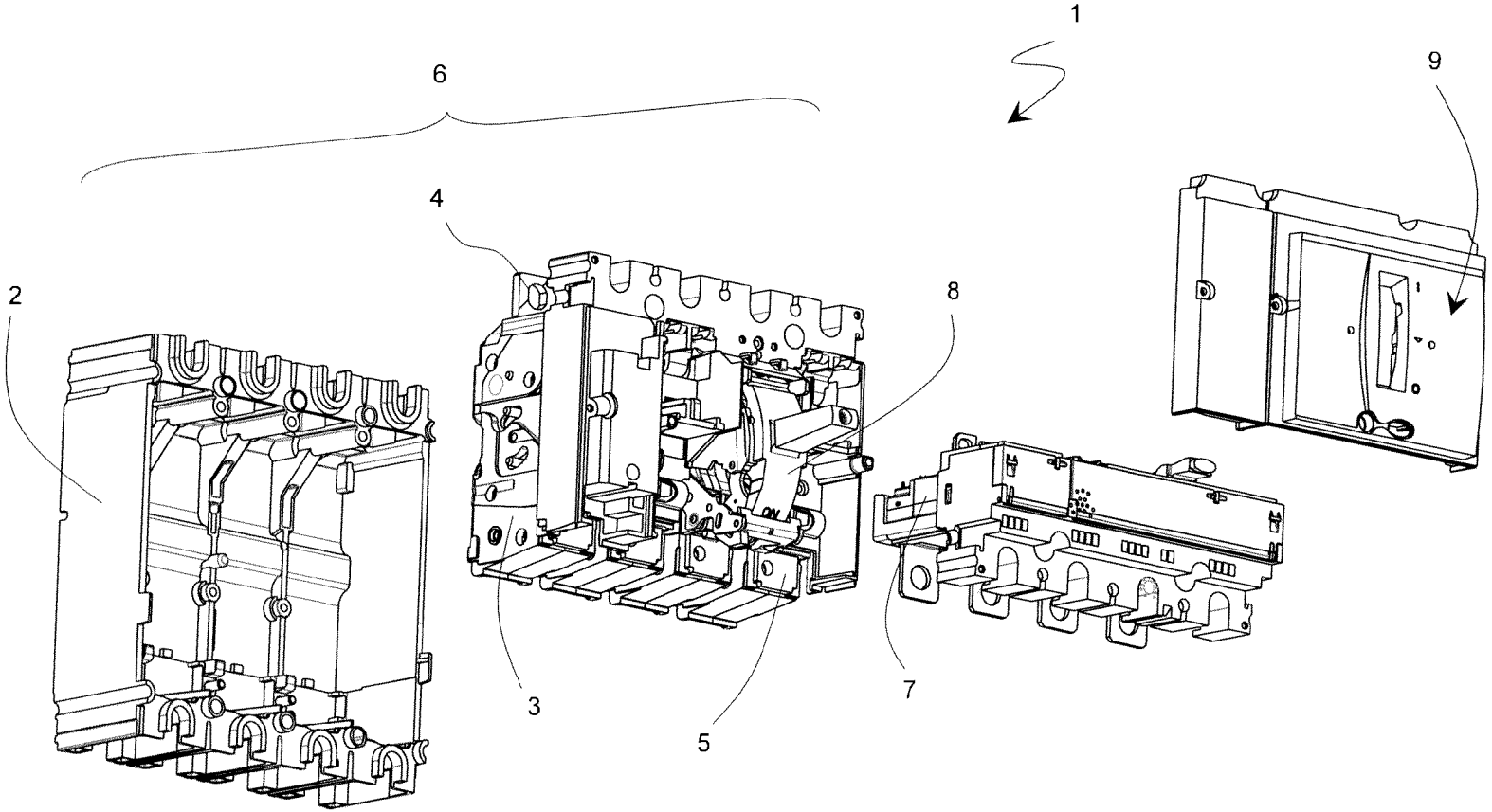
FIG. 1, which has already been described, illustrates a low-voltage multipole circuit breaker with double enclosure according to the prior art.

With a concern for simplification of presentation of a preferred embodiment of the invention, the elements composing the switchgear apparatus 1, and in particular the single-pole cartridges 3 forming the breaking device 6, will be described in relation with the position of use in which the circuit breaker 1 is fitted in place in a panel, the opposite to FIG. 1, with the nose 9 comprising the vertical handle parallel to the wall or mounting plate, the line-side connection terminal strips 4 on the electric line located at the top and the trip device 7 at the bottom. The use of the relative position terms such as "lateral", "top", "bottom", etc. should not be interpreted as a limiting factor.

Figure 2A:
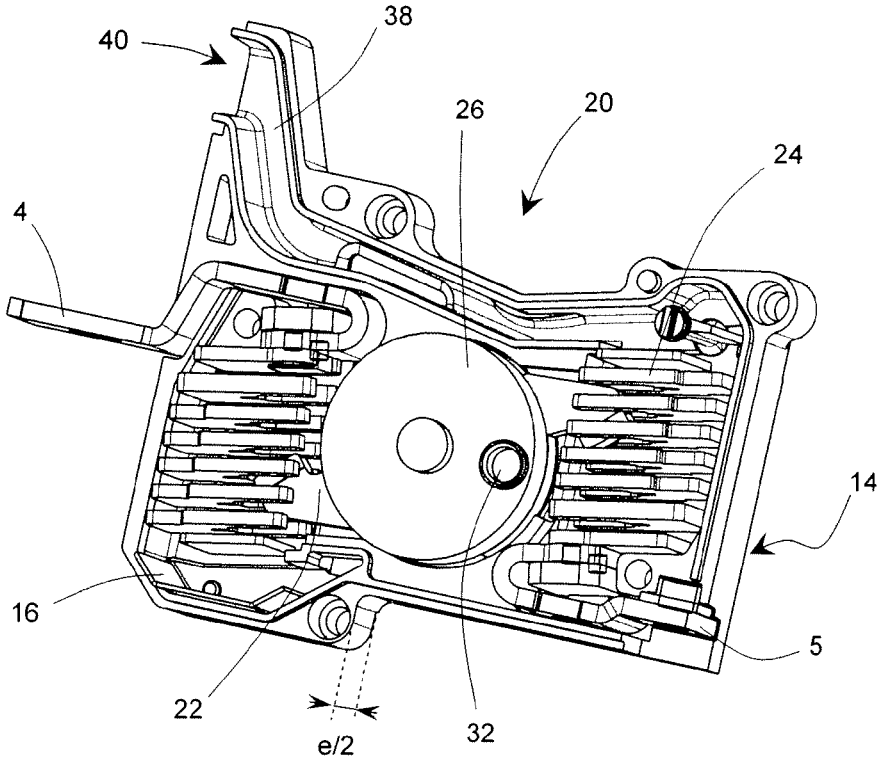
FIGS. 2A and 2B schematically show a single-pole breaking unit and a part of its case for a switchgear apparatus according to a preferred embodiment of the invention.
Figure 2B:
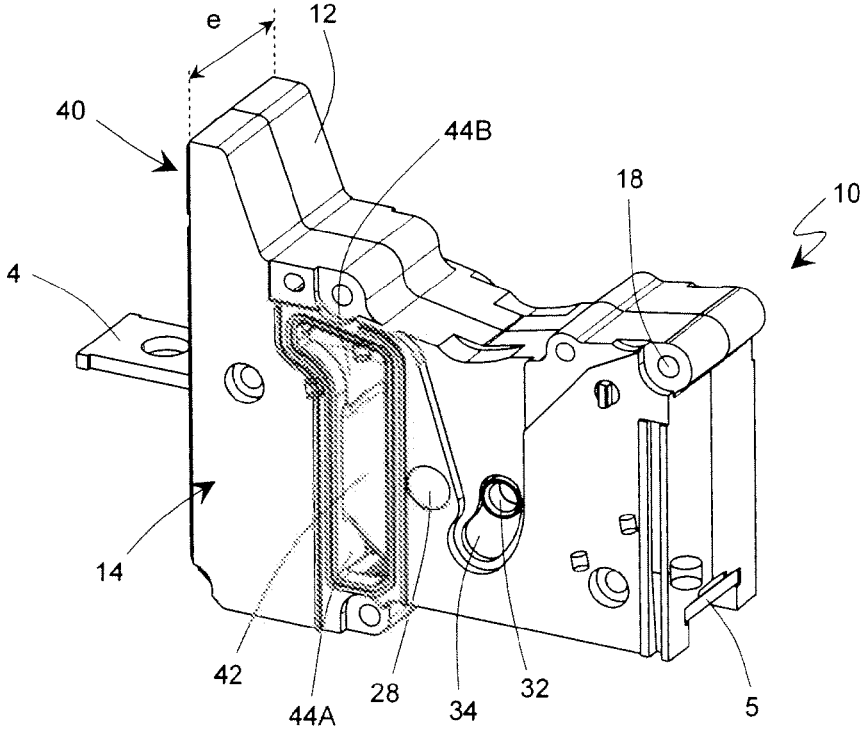

A multipole switchgear apparatus according to the invention 100, generally a circuit breaker, comprises a trip device 7 associated with a breaking device 600 comprising a plurality of cartridges 10, or single-pole breaking units, each unit 10 performing breaking of a single pole and being advantageously in the form of a flat case 12 made from moulded plastic with two parallel large panels 14 separated by a thickness e of cartridge 10 (FIG. 2B). The case 12 is formed by two parts, which preferably present mirror symmetry, secured to one another by any suitable means and each comprising a large panel 14. As illustrated in a preferred embodiment in FIG. 2A, a complementary system of tenon and mortar type enables the parts of case 12 to be adjusted to fit one another, one of the two parts comprising suitable prongs to enter recesses of the other part. Arrangements 18 are furthermore provided to enable juxtaposition of the cases 12 of the single-pole unit 10 and securing of the latter for a multipole circuit breaker 100.

The case 12 of a single-pole unit 10 forms a cavity housing the breaking elements. According to an illustrated preferred embodiment, the breaking mechanism 20 is a double rotary breaking mechanism. The circuit breaker 100 according to the invention is in fact particularly designed for applications able to reach 800 A for which single breaking may not be sufficient. Furthermore, considering the technological choices, double rotary breaking provides the best trade-off between electric performance and space occupation. In particular, in the illustrated embodiment, the thickness e is about 22 mm for a 160 A rating.

The breaking mechanism 20 is thus housed in the case 12 between two stationary conductors designed to be connected by a line-side terminal strip 4 to the power supply line and by a load-side terminal strip 5 to the trip device 7. Each part of case comprises a corresponding passage recess. A movable conductor 22 comprising a contact strip at each end is fitted pivoting between an open position in which the contact strips are separated from the stationary conductor and a current flow position in which they are in contact with each of the conductors. Arc extinguishing chambers 24 are associated with each contact area to limit electric arcs.

Advantageously, each part of the case 12 is moulded with internal arrangements enabling a relatively stable positioning of the different elements composing the breaking mechanism 20, in particular two symmetrical housings for each of the extinguishing chambers 24, and a circular central housing enabling fitting of a rotary bar 26 coupled with the movable conductor 22. It is advantageous for the rotary bar 26 to be surrounded by two flange-plates acting in particular as bearings for the latter (see French Patent application FR 09 04456 entitled: "single-pole breaking unit comprising a rotary contact bridge, breaking device comprising one such unit and circuit breaker comprising one such device"). The central housing of the case 12 can thus open out onto the outside at the level of the axis of rotation of the bar 26 via a hole 28 collaborating with a protuberance of the flange-plates.

The single-pole cartridges 10 are designed to be driven simultaneously and are coupled for this purpose by at least one rod 30 (FIG. 3A), in particular at the level of the bar 26, and for example by holes 32. According to a preferred embodiment, a single drive rod 30 is used and each part of case 12 comprises a hole 34 in the form of an arc of a circle enabling at least mobilization of the rod 30 passing through it between the current flow position and the open position. In the embodiment with flange-plates, each of the flange-plates also comprises a hole with a flange for adjusted passage of the simultaneous drive rod 30.

According to a preferred embodiment, fitting of the rotary bridge 22, 26 in a single-pole breaking unit 10 is "reversed". It is desired (see FIG. 3B) for the nose 9 of the cover of a circuit breaker 100 (comprising the passage for movement of the handle of the contact actuating mechanism 8), in its standardized 45 mm version, to be centred on said circuit breaker 100 in operation so as to limit the number of references of the prefabricated connections of the installation system, and in particular of the front panels. For this purpose, inversion of the direction of rotation of the bar 26 has been chosen, i.e. the connection terminal strip 5 to the trip device 7 is located towards the rear of the circuit breaker 100 and the line-side connection terminal strip 4 is towards the front, on top.

In this configuration, the case 12 of the breaking unit 10 advantageously further comprises arrangements enabling optimization of the gas flow, as described in particular in French Patent application FR 09 04457 entitled: "breaking device having at least one single-pole breaking unit comprising a contact bridge and circuit breaker comprising one such device". In fact, at each breaking, gases which may be charged with polluting particles are generated, in particular in the arc extinguishing chambers 24 from the contact terminal strips. It is preferable to direct these gases away from the equipment arranged in proximity to these terminal strips, in particular at a distance from the trip device 7 which may be electronic and therefore very sensitive. Conventionally, including when the direction of rotation is reversed, outlet of the exhaust gases is performed towards the fitting rail (back wall) and/or underneath the connection terminal strips 5 of the trip device 7. It is recommended to conduct the gases towards the top, and if possible towards the front, of the breaking unit 10 to avoid pollution of the bottom part of the circuit breaker the 100 and the possible electric arc flashovers related therewith. In particular, the substantially rectangular shape of the enclosure of the breaking mechanism 20 is extended on the front side by a gas exhaust channel 38 in order to direct the latter towards the load-side terminal strip 5 (coupled with the trip device 7) towards the top part of the switchgear apparatus 100, with an open hole 40.

Furthermore, the gases from the contact connected to the line-side terminal strip 4 are advantageously also directed towards this exhaust channel 38 to be moved away from the fitting means of the switchgear apparatus 100, in particular a DIN rail and/or mounting plate, and from the power connections. For this purpose, a lateral exhaust channel 42 is arranged outside the breaking mechanism 20, with in particular two holes 44A, 44B opening out on each part of the case 12 towards the external channel 42 to the cartridge 10, which can be hollowed out in the wall of the case 12 or added between the cartridges 10. As, according to the invention, the single-pole units 10 are assembled by means of spacers 46 to form the double enclosure 48, it is advantageous to take advantage of this architecture to integrate the exhaust channel 42 lateral to the spacer 46.

Figure 3A:
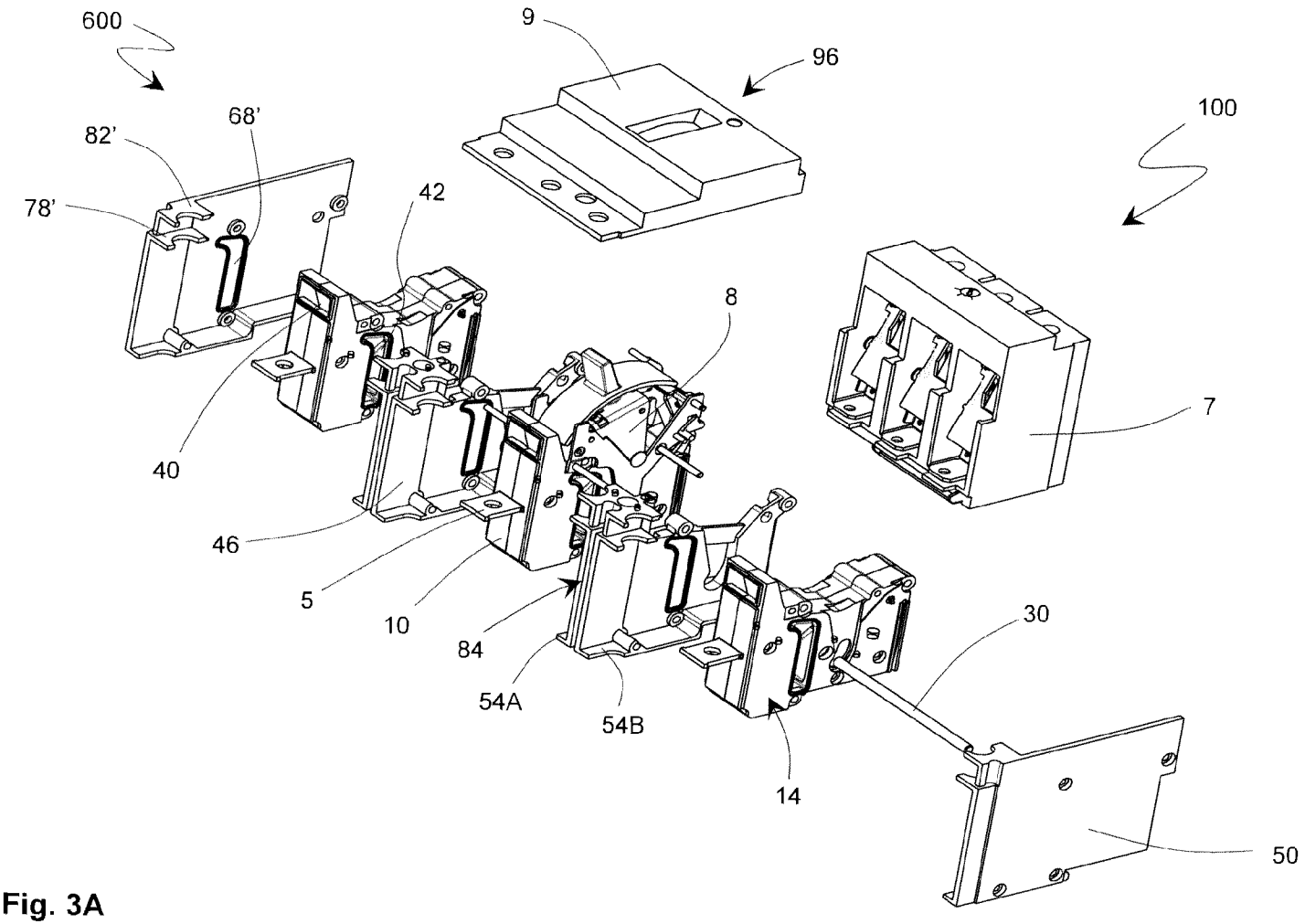
FIGS. 3A and 3B represent steps of fitting of a switchgear apparatus according to a preferred embodiment of the invention.
Figure 3B:
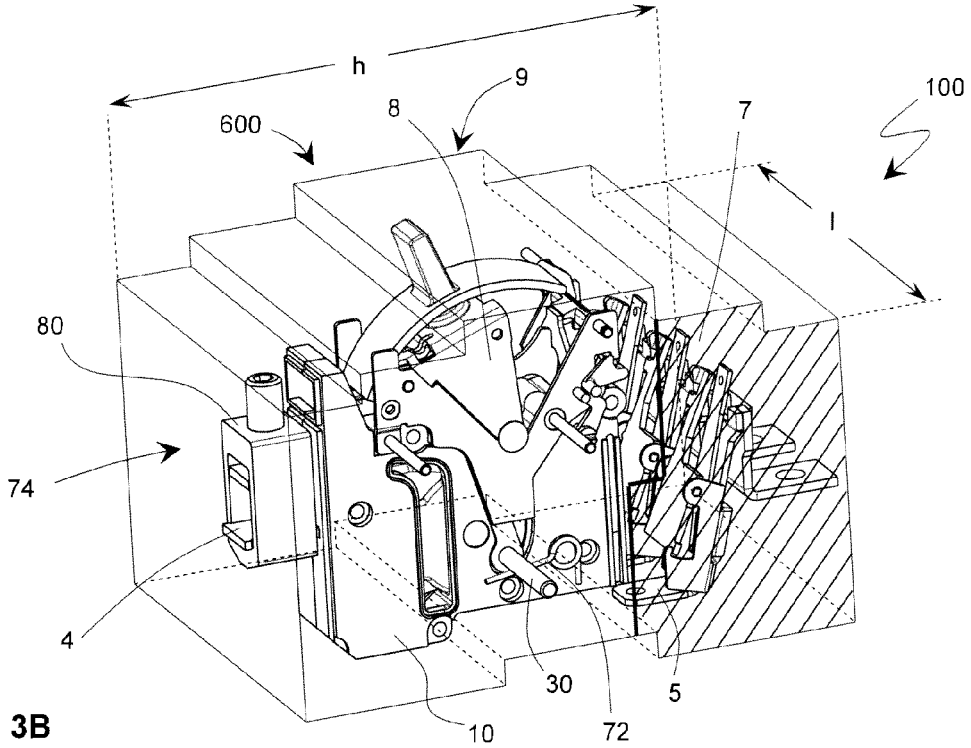

Unlike the prior art, the external enclosure 48 of the breaking device 600 is in fact not formed by a moulded case 2 in which the cartridges 10 coupled in functional manner are fitted. As illustrated in FIG. 3A, a number n of similar single-pole units 10 corresponding to the number of poles of the circuit breaker 100 (three in the illustrated embodiment), one of which, preferably the central one, is provided with a conventional actuating mechanism 8, is juxtaposed with a number n-1 of spacers 46 separating them, and closed by two external side walls to form a breaking device 600 with double enclosure which can as usual be associated with a trip device 7. This architectural choice takes maximum advantage of the modularity of the system while at the same time keeping the functional aspects: various options, such as the number n of poles, width l of the device 100, 600, choice of trip device 7, . . . are possible with a limited number of reference elements.

Figure 5:
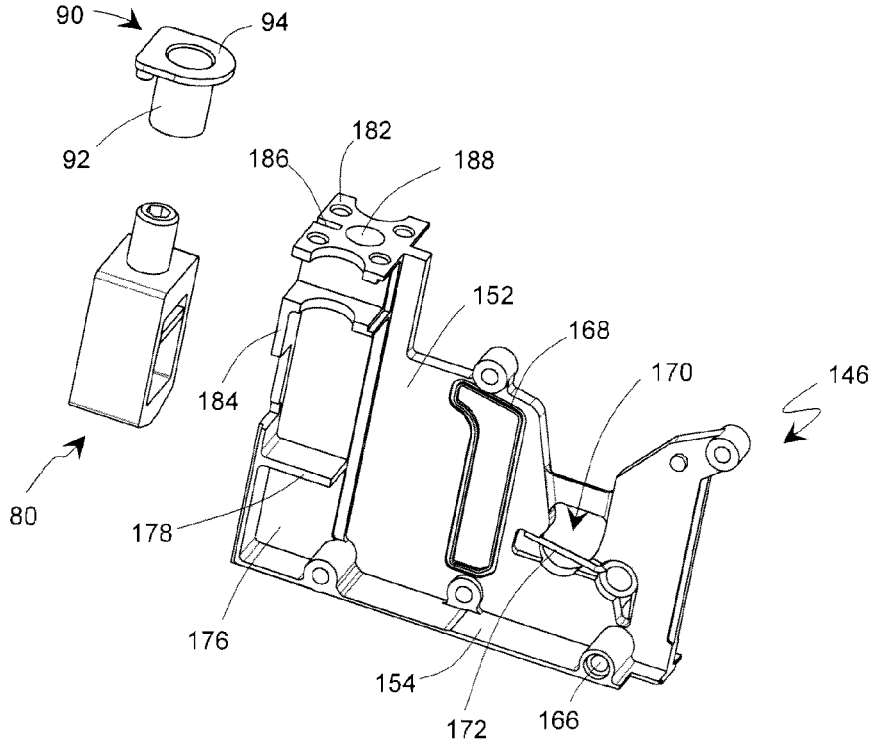
FIG. 5 shows another embodiment for a spacer.
Figure 4A:
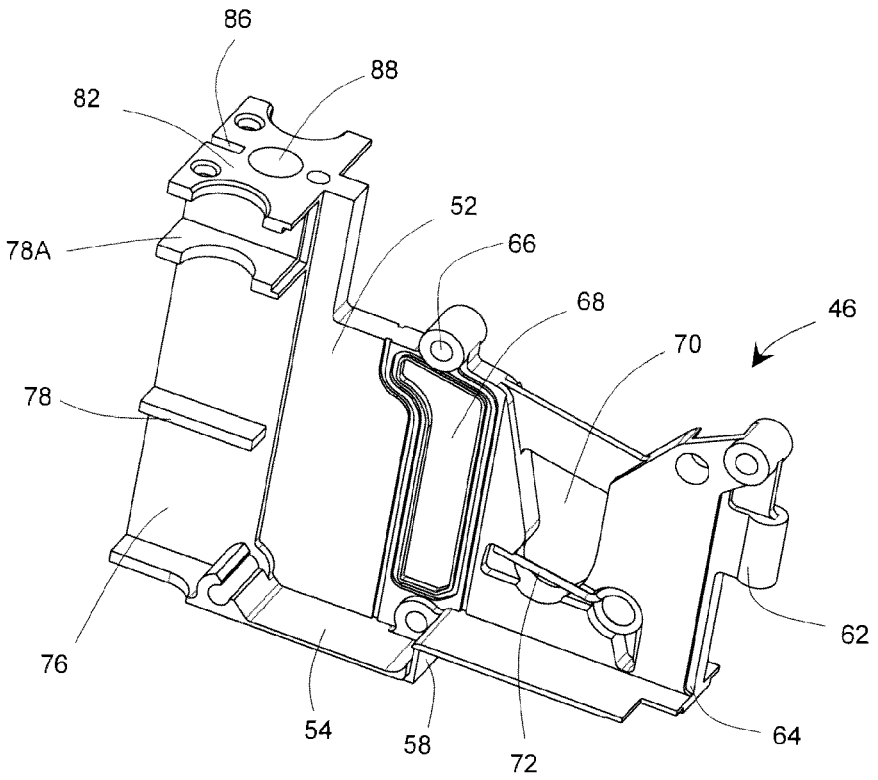
FIGS. 4A and 4B show a spacer and assembly thereof for a breaking device according to a preferred embodiment.
Figure 4B:
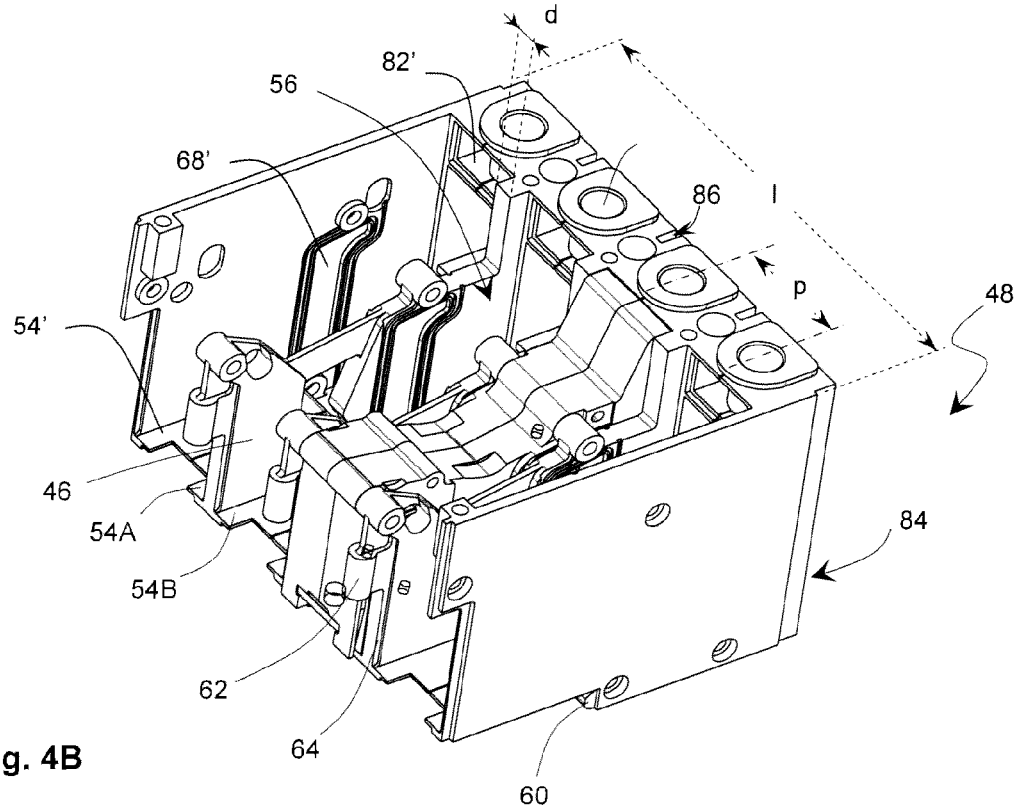

In particular, as illustrated in FIGS. 4 and 5, the spacers 46, 146 are made from moulded plastic and mainly comprise a central partition 52, 152 designed to be parallel to the large panels 14 of the cartridges 10, and a base 54, 154 substantially perpendicular to the central partition 52, 152 on a rear side. Advantageously, the base 54 of a spacer 46 is formed by two symmetric edges 54A, 54B on each side of the partition 52. Juxtaposition of two spacers 46 thus defines a cavity 56 in which a single-pole breaking unit 10 is housed. Advantageously, the opposite bottom edges 54 of the two spacers 46 close the cavity 56 at the rear of the latter when the spacers 46 are clamped to one another, but other options are possible depending on the standards in force and the assembly conditions. Juxtaposition of the bottom edges 54 forms the bottom of the breaking device 600 of the circuit breaker 100, which can be designed for different types of assembly. In particular, as illustrated in FIG. 4, the bottom edges 54 can be designed in such a way as to enable direct latching onto a DIN rail, with a shoulder 58 and possible suitable means such as a latching nose 60. For other uses, as illustrated in FIG. 5, the edges 154 can be solid and flat.

The central partition 52, 152 of each spacer 46, 146 comprises a main separating part the shape of which is substantially included in the shape of the large panel 14 of the breaking unit 10. Its thickness d is substantially constant with the exception of the functional arrangements, with integral moulding on a rear side of the two bottom edges 54A, 54B. The load-side surface of the cartridges 10 is designed to be coupled with a trip device 7, at the level of the terminal strips 5. The latter will ensure tightness so that the enclosure 48 can remain devoid of wall at this location, and the bottom side of the spacers 146 can remain devoid of any protuberance (FIG. 5). To facilitate assembly of the trip device 7, it may be advantageous to provide this side with securing means, for example a fixing guide 62 enabling for example securing screws to be anchored between the cartridge 10 and trip device 7. Guide grooves 64 can also be provided on the surfaces of the central partition 52 on this edge so as to enable easy, stable and precise insertion of the single-pole units 10, or even of the trip device 7 (FIG. 4A).

The central partition 52 of the spacers 46 delineates the cavities 56 in which the breaking cartridges are fitted. The means for securing the elements to one another, in particular holes 66, 166 for passage of rivets are provided. The securing means also comprise complementary shapes so that the assembly formed by the spacer 46, 146/cartridge 10 is compact and forms a unitary mechanical assembly, securing being stable and on a sufficient surface. As mentioned in the foregoing, a spacer 46 can comprise arrangements enabling the lateral gas exhaust channel 42 to be defined. The channel 42 is advantageously partially etched in the external large panel 14 of the case of the cartridge 10, between the two outlet holes 44, and a corresponding element 68, 168, etching and/or protruding contour on the central partition 52, 152 enables the gases to be directed precisely from the exhaust outlet 44A to the top hole 44B along the partition 52 towards the exhaust channel 38, when juxtaposition and securing of the spacer 46 on the cartridge 10 are performed.

The central partition 52, 152 is further in particular provided with passages 70, 170 for the functional parts connecting the cartridges. In the preferred embodiment, a recess 70, 170 for passage of the drive rod 30 of the different unitary units 10 is provided. The recesses 70, 170 can be partially obstructed, in particular at the level of the top part, for reasons of stability and strengthening.

According to a preferred embodiment, the passage of the drive rod 30 of the bars 26 is associated with mechanical assistance means 72, 172. In particular, according to one embodiment, the mechanical assistance means can comprise means forming a spring, in particular a torsion spring 72, enabling the device 600 to be activated to opening. It is in fact desired for the opening time of the contacts, in particular in case of tripping, to be as short as possible, and the above-mentioned breaking device 600 may be a little slow, with risks of flashovers at high voltage (690 V) and the related low performances on overload and/or endurance.

In order to palliate this problem while at the same time respecting the recommended dimensional constraints, it is possible to fit accelerating means at the beginning of opening (FR 2 762 768), in particular energy storage means, which can, in the present case, be in the integrated in the spacer 46. According to a preferred embodiment, a spring 72 is integrated in the central partition 52 and acts directly on the rod 30 when movement of the latter takes place from the current flow position. In the closed position of the breaking device, the energy storage means 72 are compressed, i.e., when opening takes place, the movable assembly (bar 26, movable conductor 22, actuating means 8) is propelled by the springs of the actuating mechanism 8 but also by the energy stored in the assistance means 72.

According to another embodiment, the mechanical assistance means 172 act on closing. At the end of closing travel of the contacts, the excess energy of the actuating mechanism 8 is partially stored in the energy storage means 172, which can also comprise a torsion spring, so as to reduce the stress on the other parts of the enclosure 48 of the circuit breaker 100. It is thus further possible to over-dimension the springs of the actuating mechanism 8 without any fear of phenomena of bouncing or nuisance tripping on an operating shock.

The two mechanical assistance means can be associated on a single spacer. It is possible to provide only two spacers 46 surrounding the breaking cartridge 10 equipped with an actuating mechanism 8 and/or only the spacer associated with an end breaking cartridge, displaced in the case of a four-pole circuit breaker, and/or only the spacers used for certain power ranges, with mechanical assistance springs 72, 172. According to an embodiment that is advantageous from a logistic point of view, all the spacers 46 comprise a mechanical assistance element 72.

The top part of the central partition 52 of the spacers 46 is designed to be fitted facing the line-side terminal strips 4 of the cartridges 10 and to form the top surface 74 of the breaking device 100. In particular, the central partition 52, 152 comprises a part 76, 176 adjacent to this top surface which is not designed to be juxtaposed with a breaking cartridge 10, but to support the connection elements of the power supply line on the line-side terminal strip 4. The end part 76, 176 of the partition is substantially equal to the size of the protruding length of said terminal strip 4. The central partition 52, 152 preferably comprises securing means 78, 178 of the connection terminals 80 on said end part 76, 176. In particular, protuberances 78, 178 substantially perpendicular to the partition 52, 152 and parallel to the bottom edges 54, 154 delineate a housing of a tunnel terminal 80 which is placed around the terminal strip 4. Preferably, two protuberances 78 surround a housing, the upper protuberance 78A being provided with a recess for passage of a screw of the terminal 80. One of the protuberances 82, 182 is advantageously located on the central partition 52, 152, at the level of the opposite edge and parallel to the bottom edge 54, 154. The protuberance 82, 182 can then act as support for a closing cover. The support 82, 182 composed in this way is also provided with a recess for passage of a screw of the terminal 80. It can coincide with the top protuberance 78A, but, in the preferred embodiment, the space between the support 82 and the top protuberance 78A defines a passage corresponding to the passage 40 for removal of the gases from the cartridge 10.

According to the embodiment and/or the standard in force, the end part 176 of the partition 152 can be provided with top edges 184 partially closing the housings defined by the protuberances 178 (FIG. 5). In this case, it is advantageous, as for the bottom edges 154, for the top edges 184 to be complementary to form a solid wall when securing between the spacers 146 and cartridges 10 is performed, with the exception of passages for removal of the gases and access to the connection terminal strips 4. If however it is desired to associate a wide offer of connection possibilities with the breaking device 100 according to the invention, it can be envisaged to limit the top edges 84 to the cross-section of the protuberances 78 and support 82 in their thickness (FIGS. 3 and 4). In this way, access to the connection terminal strip 4 is free and it is possible to choose the type of connection directly during installation, using for example a modular connection such as described in the document FR 2 687 248.

The top side 84 of the central partition 52 of the spacers 46 is designed to form the top surface 74 of the breaking device 100. As is required by standards, elements designed to form the creepage distances are provided to separate the breaking units 10 from one another. In particular, slots 86 are present in the thickness of the central partition 52, 152. The slot 86 extends orthogonally to the bottom part over a constant depth and width so that, whatever the shape of the spacers 46, the top wall of the breaking device 100 comprises a pass-through slot 86, between each pole, between the bottom of the surface of the breaking device 600, the dimensions of which are adapted to the standard defined for the value of the creepage distance, and delineated by two insulating edges comprising the residual thickness of the central partition 52, 84 and the edges 54, 82, if any, which are associated therewith. A protruding element 186 can replace the slot 86, for example a protuberance of complementary shape to the groove illustrated in FIG. 4. As schematized in FIG. 5, the element 186 is salient from the top side and in the thickness of the central partition 152. Parallel to the plane of the partition 152 and of small thickness, it passes right through from the bottom edge 154 to the surface of the breaking device 600.

In parallel with the creepage part 86, 186, a pass-through hole 88, 188 is drilled in the partition 52, 152 enabling the switchgear apparatus 100 to be coupled with a mounting plate or other support. The mechanical stresses caused by latching on a vertical wall of the circuit breaker 100 are in fact taken up directly by its enclosure 48 and, according to the invention, by the spacers 46, 146 forming the strengthening part of the apparatus 100. The central partitions 52, 152, at the level of their top end part 76, 176, are provided with suitable means 88, 188.

The side walls 50 completing assembly of the breaking device 600 correspond functionally more or less to a half of a spacer 46. The wall 50 however, unlike the central partition 52, is of substantially rectangular shape in order to form a breaking device enclosure 48 of conventional shape on which any type of trip device 7 can be fitted. In particular, the side wall 50 comprises a substantially flat external surface and an internal surface provided with the same arrangements (lateral channel 68', securing protuberance 78', support 82') as the central partition 52 of the spacers 46, with the exception of the cut-out 70 for passage of the drive rod 30 (and of the associated energy storage means 72). The bottom edges 54' and support 82' are substantially identical to those of the spacers 46, but are naturally only situated on one side of the side wall 50.

It is thus apparent that the general size of the enclosure 48 of the circuit breaker 100 is determined by the thickness d of the central partitions 52 and side walls 50, and the thickness e of the cartridges 10. It thus becomes possible, with the same single-pole breaking units 10, to modify the width 1 of the circuit breaker 100, and even its height h. It is true that a minimum height dimension between the line-side connection terminal strips 4 of the circuit breaker 100 and the load-side connection terminal strips of the trip device 7 is always desired. In a preferred option, the height of the apparatus 100 of 160 A range is about 130 mm with a standard trip device 7, and the breaking device 600 has a height h of at least 90 mm. On the other hand, the width l of the circuit breaker 100 preferably complies with standards that can be easily chosen, considering the architecture according to the invention. The distance between the middle of two cartridges 10 determines the pitch p of the breaking device 100, which is preferably constant and in compliance with usages.

Indeed, the partitions 52 of the spacers 46 and the side walls 50 are associated with the cartridges 10 in tight manner so as to ensure tightness of the gas flow passage and to perform mechanical support of the cartridges 10. It is thus possible, for the same thickness e of cartridge 10, to adjust the thickness d of the partitions 52 to meet the criteria of metric or imperial polar pitch p. In particular, for an apparatus 100 of 160 A range, the unitary breaking units 10 are designed to be suitable for a polar pitch p according to the systems in force, for example e=22 mm, and two sets of spacers 46 are provided, one for imperial polar pitch (1 inch, i.e. 25.4 mm) and the other for the conventional metric pitch which is a multiple of 9 mm, and in particular p=27 mm for the total width of the cavities 56 taken from the centre of each central partition 52, i.e. a central partition 52 of respective mean thickness d=3.4 and d=5 mm (the mean thickness d corresponds to the thickness of the partition 52 over it separating part, with the exclusion of the functional protuberances, for example at the level of the lateral channel 68 or of the complementary arrangements 66 for securing to the cartridges 10). It is advantageous, to comply with the global pitch p in the fitting cabinet, for the side walls 50 to have a thickness that is also modified, corresponding to half of the mean thickness d of the central partitions 52. According to another option, the thickness of the partition 52 remains identical for the two sets of spacers, but the protuberances enabling tight securing of the cartridges are more or less wide.

Advantage can also be taken of this modularity to provide spacers 46 suitable for the assembly mode of the circuit breakers 100, and in particular provided or not on their bottom edges 54 with latching means 58, 60 onto a DIN rail. Other functionalities can moreover be fitted in or on the spacers 46, such as sensors or others.

The assembly method of a multipole circuit breaker 100 thus comprises juxtaposition, possibly with sliding engagement, of a number n of identical breaking units 10, one of the units, preferably the central unit, being provided with an actuating mechanism 8, each unit 10 being separated from an adjacent unit by a spacer 46. Depending on the option chosen, the terminals 80 can be fitted around the line-side connection terminal strips 4 at this stage. These 2n-1 elements 10, 46, possibly associated with n terminals 80, are secured to form a tight assembly by suitable means, in particular by riveting in the provided holes 66, and associated with the simultaneous drive rod 30 which is inserted in the bars 26 of the breaking units 10.

The switchgear unit is then closed by the side walls 50, finishing and securing of this assembly being performed for example by pass-through rivets. According to a preferred embodiment, assembly is completed by securing the supports 82 of the spacers 46 to one another by means of strengthening means 90 around the passage holes of the screws of the terminals 80. In particular, the strengthening means 90 (FIG. 5) can comprise a tubular enclosure 92 designed to protect the screw against the exhaust gases outlet via the passage 40, and to protect the user from a direct access to the screws, the enclosure 92 being associated at one end with an orthogonal plate 94 able to be coupled to the supports 82 of two spacers 46, or of a spacer 46 and a side wall 50. Guide means such as holes and/or complementary prongs can be provided in the plate 94 and support 82. Clip-fastening can also be envisaged.

The assembly is closed by a cover 96 by any suitable means to form a breaking device which can then be associated, via its bottom surface, with any trip device 7 of the same width l and with the same number of poles. Due to this configuration, the trip device 7 can thus be defined at an advanced stage of assembly. Furthermore, in the preferred embodiment in which the direction of rotation of the bar 26 is reversed, fitting of the trip device 7 and coupling of the latter with the breaking device 600 are facilitated by access from the bottom of the breaking device and guiding by grooves on the cartridges 10 (see FIG. 2B) or on the spacers 46, and/or securing prongs 62 in the spacers 46. According to an alternative, the cover 96 is only fitted on the breaking unit already associated with the trip device 7, by "overspilling" from the spacers 46 and covering the whole of the front panel of the switchgear apparatus 100.

The circuit breaker 100 obtained in this way enables the following industrial requirements that are at first sight antinomic to be complied with:

- the same architecture can be used for the whole range up to 800 A due to the use of non-limited double breaking with rotary bridge;
- the reliability of the breaking mechanisms 20 and optimization of the latter are ensured by the use of well-proven solutions;
- the trip device 7 can be connected via the bottom to the breaking device 600, which gives a better accessibility to the connecting screws due to reversal of the direction of rotation of the breaking bridge 26;
- interchangeability of the trip devices 7 is complete enabling greatly delayed differentiation of the apparatuses 100;
- the dimensions of the switchgear apparatus 100 remain small, in particular the height h, in spite of the optimized performances and modularity, the different functions be integrated in a predefined enclosure, which can be a 130 mm enclosure for a 160 A, in particular due to modified gas removal;
- two polar pitches p, in particular 25.4 and 27 mm pour 160 A, are possible by modifying a minimum number of constituent parts (spacers 46, side walls 50, cover 96), which are moreover simple to produce, from moulded plastic;
- the different fitting systems in the electrical equipment, in particular on a DIN rail, can be used by modifying unitary parts 46, 50 made from moulded plastic;
- the 45 mm nose 9 of the cover 96 of the switchgear apparatus 100 is centred, in particular at 42.5 mm, due to reversal of the direction of rotation in the breaking units 10, which enables symmetrical front cover plates to be used in the cabinets;
- the quenching gases are not removed next to the trip device 7, which limits pollution on this element which may be sensitive, in particular in its electronic version, and frees space;
- outlet of the exhaust gases is no longer performed under the connections 4, 5 of the circuit breaker 100, which limits the risks of flashovers on current breaking;
- power connection 80 can be modular, depending on the choice of the spacers 46, 146;
- various functions can be modified and/or added late in manufacture by modification of the spacers 46 which it is possible to change at a very late stage.

Although the invention has been described with reference to a three-pole switchgear apparatus 100 comprising all the preferred functionalities, it is not limited thereto. The different options can be combined in other configurations. In particular, the options described in relation with one or the other of the embodiments of the spacers 46, 146 illustrated in FIGS. 4 and 5 can be combined in different manner and/or omitted. For example, the spacers 46 can be L-shaped instead of T-shaped, with two types of different side walls 50. The embodiment presented can further be adapted to any kind of breaking, and in particular to single-pole units 10 with double breaking in translation, with relevant modification of the shapes and thicknesses. Likewise, if a range of 250 A apparatuses, respectively 630 A apparatuses, is scheduled, it is easy to modify the scheduled pitches p (for example 35 mm and 1.5 inches, respectively 45 mm).

The invention claimed is:

1. A multiple electrical switchgear device comprising:

a substantially rectangular parallelepiped double enclosure comprising:

two side panels, a bottom panel orthogonal to the two side panels, a top panel orthogonal to the side and bottom panels, and line-side connection terminal strips accessible from the exterior of said enclosure;

said enclosure housing:

a plurality n of single-pole circuit breaking units, each unit comprising a case with two parallel unit side panels, and between said unit side panels a breaking mechanism, a first line-side connection terminal strip, and a second load-side connection terminal strip extending outwardly from the case a plurality n-1 of spacers, each one of which separates each adjacent pair of single-pole breaking units, each spacer comprising a central partition parallel to the unit side panels, each central partition having at its top a portion extending generally perpendicularly to said top to provide a creepage distance.

2. The switchgear device according to claim 1 wherein the creepage distance is provided by a slot in the thickness of said portion of the central partition which further includes in its thickness a pass-through hole adjacent to said slot.

3. The switchgear device according to claim 1 wherein each breaking unit additionally comprises a rotary bridge liar double breaking a connection between the line side terminal strip and the load-side terminal strips.

4. The switchgear device according to claim 1 wherein each breaking unit includes a through-pass gas outlet channel and the top surface of each unit includes a gas outlet hole.

5. The switchgear device according to claim 1 additionally comprising lateral gas outlet channels extending from side to side through the unit side panels of the single-pole breaking units, said lateral channels defined by the spacers and the cases of the single-pole breaking units.

6. The switchgear device according to claim 1 wherein the spacers are symmetrical with respect to their central partition and identical to one another.

7. The switchgear device according to claim 1 wherein the single-pole breaking units are connected by a rod passing from side-to-side through the breaking units for simultaneously driving them, and wherein each spacer comprises mechanical assistance means connected to the rod.

8. The switchgear device according to claim 1, each breaking unit further comprising a terminal of the line-side terminal strip inside the case of that unit.

9. A switchgear apparatus comprising a multipole switchgear device according to claim 1 and an associated trip device located at the level of the load-side connection terminal strips.

10. A method or assembling a multi-pole switchgear device of claim 1, said method comprising:

arranging said plurality of n single pole breaking units side-by-side adjacent each other;

inserting said plurality of n-1 spacers each between each adjacent pair of said single pole breaking units;

inserting a drive rod through the sides of the plurality of braking units and the plurality of spacers;

securing by clamping the adjacent breaking units and spacers;

clamping an external end panel on the exposed sides of each of the outermost breaking units;

connecting a multi-pole trip device to the line-side connection terminal strips of the adjacent breaking unit;

and attaching a top panel closing an area between the first line-side and the second load-side.

11. The assembly method according to claim 10 wherein arranging said single-pole breaking units comprises locating said load-side connection terminal strips closer to the top panel than to the opposite surface of the switchgear device.

12. The assembly method according to claim 10 additionally comprising fitting terminals around the load-side connection terminal strips prior to clamping the spacers and single-pole breaking units, said spacers comprising at least one top edge perpendicular to a central partition around a portion providing creepage distances.

13. The assembly method according to claim 12 further comprising fitting strengthening devices on the terminals.

* * * * *